United States Patent [19]

Murasaki

[11] 4,252,155

[45] Feb. 24, 1981

[54] DRIVE MECHANISM FOR BEAT-UP REED AND SELVEDGE FORMING NEEDLE IN NEEDLE LOOM

[75] Inventor: Ryuichi Murasaki, Tateyama, Japan

[73] Assignee: Yoshida Kogyo K.K., Tokyo, Japan

[21] Appl. No.: 33,227

[22] Filed: Apr. 25, 1979

[30] Foreign Application Priority Data

May 9, 1978 [JP] Japan ..... 53-61973

[51] Int. Cl.[3] ..... D03D 47/42

[52] U.S. Cl. ..... 139/431; 139/190

[58] Field of Search ..... 139/430, 431, 432, 433, 139/441, 449, 190

[56] References Cited

U.S. PATENT DOCUMENTS

| | | | |
|---|---|---|---|
| 96,564 | 11/1869 | Duckworth | 139/431 |
| 3,519,029 | 7/1970 | Piazzolla et al. | 139/431 |
| 3,901,285 | 8/1975 | Griffith | 139/442 |

*Primary Examiner*—Henry Jaudon

*Attorney, Agent, or Firm*—Robert E. Burns; Emmanuel J. Lobato; Bruce L. Adams

[57] ABSTRACT

A mechanism for driving a beat-up reed and a selvedged forming needle in timed relation in a needle loom is disclosed. The mechanism comprises a pair of parallel spaced first and second rock shafts to which a reed carrier arm and a selvedge forming needle carrier arm are respectively attached. Only one of the first and second rock shafts is driven by a drive means to oscillate through a predetermined angle. There is a linkage connecting the first and second rock shafts for transmitting such oscillatory motion of one of the first and second rock shafts to the other. The linkage includes a pair of levers angularly adjustably connected to the first and second rock shafts, respectively, and a link connected at opposite ends to respective free ends of the levers.

3 Claims, 4 Drawing Figures

DRIVE MECHANISM FOR BEAT-UP REED AND SELVEDGE FORMING NEEDLE IN NEEDLE LOOM

BACKGROUND OF THE INVENTION

1. Field of the Invention

This invention relates generally to needle looms, and more particularly to a drive mechanism for a beat-up reed and a selvedge forming needle in a needle loom.

2. Prior Art

In most of the known types of needle looms, a beat-up reed and a selvedge forming needle are actuated separately by two independent drive mechanisms which are in turn driven by a single driving shaft. This machine arrangement has a disadvantage in that in order to time the reed motion with the selvedge forming needle motion, it is necessary to individually preset the various parts of these separate mechanisms to a nicety at the expense of a great deal of laborious and meticulous workmanship.

SUMMARY OF THE INVENTION

According to this invention, a pair of first and second arms are mounted on a pair of parallel spaced first and second rock shafts, respectively, and are adapted to carry on their respective free ends a beat-up reed and a selvedge forming needle. Only one of the first and second rock shafts derives its oscillatory motion directly from a drive means. There is a linkage connecting the first and second shafts for transmitting the oscillatory motion of one to the other, so that the selvedge forming needle can be moved to and fro in timed relation to an oscillatory motion of the beat-up reed. The linkage includes a pair of levers angularly adjustably connected at their respective one ends to the first and second rock shafts, and a link connected at opposite ends to the other ends of the levers.

Accordingly, it is an object of the invention to provide an improved drive mechanism for a beat-up reed and a selvedge forming needle in a needle loom, which can reduce the number of adjusting parts to an absolute minimum and hence allow the timing of the reed motion with the selvedge forming needle motion with maximum ease.

A fuller understanding of the invention will be had by referring to the following description taken in conjunction with the accompanying drawings.

DETAILED DESCRIPTION OF THE PREFERRED EMBODIMENT

Figure 1:
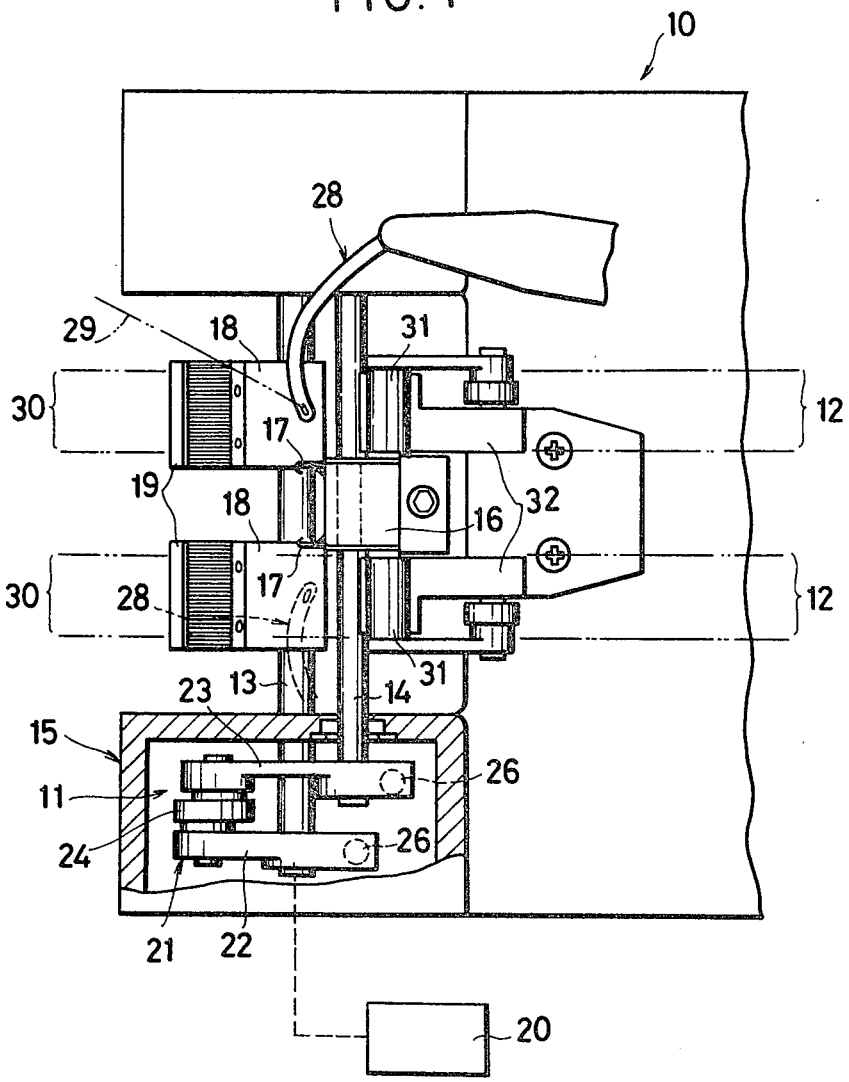
FIG. 1 is a fragmentary plan view of a needle loom incorporating a drive mechanism of the type constructed according to this invention.
Figure 2:
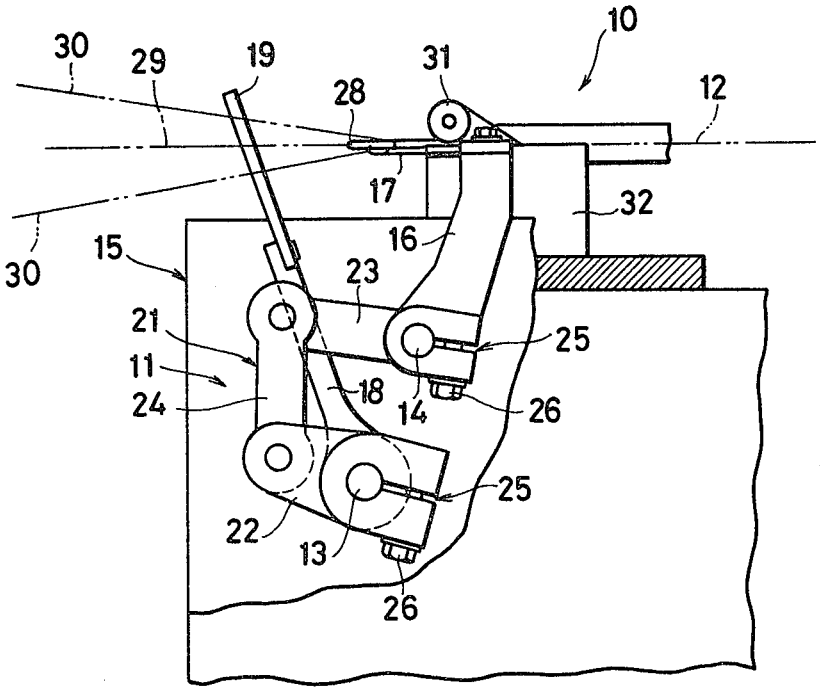
FIG. 2 is a fragmentary front view of the needle loom of FIG. 1.

With reference to FIGS. 1 and 2, there is fragmentarily shown a needle loom generally indicated by the numeral 10, on which a drive mechanism 11 for beat-up reed and selvedge forming needle motions is mounted.

The drive mechanism 11 comprises a pair of parallel spaced first and second rock shafts 13, 14 supported on a frame 15 of the needle loom 10. Either of rock shafts 13, 14 is disposed below the fabrics 12, 12 being woven and extends transversely across the fabrics, as viewed from the top in FIG. 1. The first rock shaft 13 is disposed below the second rock shaft 14 slightly off to the left (FIG. 2).

Figure 4:
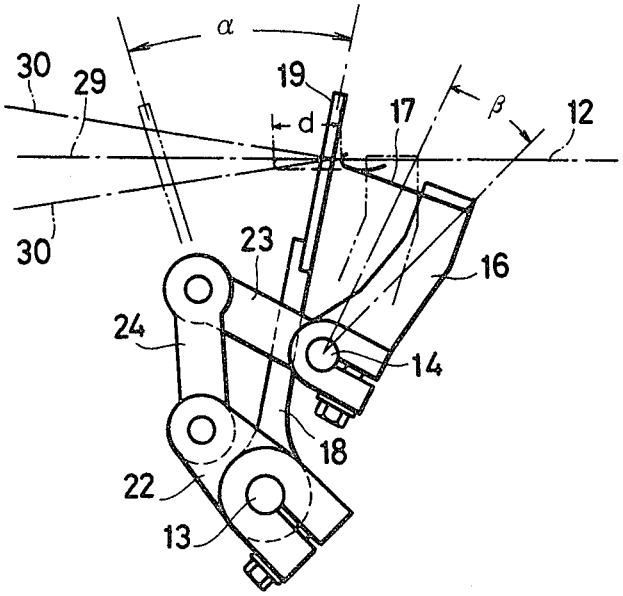
FIG. 4 is a view similar to FIG. 3 but showing the mechanism in its beat-up disposition.

There are a pair of reed carrier or first arms 18,18 mounted on the first rock shaft 13 and laterally spaced from each other, so that a pair of fabrics 12,12 can be woven simultaneously. Attached to each arm at its free end is a beat-up reed 19 extending radially of the first rock shaft 13 and outwardly from the first arm 18 through the warp shed. A needle carrier (or second) arm 16 is mounted on the second rock shaft 14. A pair of opposed latch needles 17,17 are attached to a free end of the needle carrier arm 16 on its opposite sides so as to extend alongside of and parallel to respective confronting selvedges of the two fabrics 12,12. The first rock shaft 13 is driven by a suitable well-known drive means 20 (illustrated by a block in FIG. 1 for clarity), such as an eccentric, to reciprocate through a predetermined angle $\alpha$ (FIG. 4). Thus, the beat-up reed 19 derives its requisite oscillatory motion from the drive means 20 via the first rock shaft 13. Alternatively, the beat-up reed 19 may be directly attached to the first rock shaft 13.

The drive mechanism 11 further comprises a linkage 21 connecting the first and second rock shafts 13,14 for transmitting such oscillatory motion of the first rock shaft 13 to the second shaft 14 so as to reciprocate the selvedge forming needle 17 through its requisite distance d (FIG. 4) in timed relation to the beat-up reed motion. The linkage 21 includes a pair of first and second levers 22,23 connected at their respective one ends to the first and second rock shafts 13,14, and a link 24 connected at opposite ends to the other ends of the first and second levers 22,23.

Alternatively, the second rock shaft 14, instead of the first rock shaft 13, may be driven by the drive means 20 to obtain its requisite oscillatory motion directly therefrom, in which instance this oscillatory motion is transmitted by the same linkage 21 conversely from the second rock shaft 14 to the first rock shaft 13.

Each of the first and second levers 22,23 is fastened to one of the first and second rock shafts 13,14 by means of a ring-shaped clamp 25 and a bolt 26 which jointly constitute an angular position adjusting means. Accordingly, the first and second arms 18,16, after slackening of the corresponding clamp 25, can be moved angularly relative to the first and second levers 22,23, respectively, thereby adjusting the position of the beat-up reed 18 and that of the selvedge forming needle 17, respectively.

Amongst other several parts of the needle loom 10 which are shown in FIGS. 1 and 2, designated at 28 is a weft inserter pivotally movable to insert a weft thread 29 through a shed of warp threads 30 into the space between the beat-up reed 19 and the selvedge forming needle 17; at 31 is a fabric guide; at 32 is a support plate for supporting thereon a fabric 12.

The drive mechanism 11 thus constructed functions in the following manner. As the fabric 12 is progressively woven of the warp threads 30 and the weft thread 29 in the needle loom 10, the first rock shaft 13 driven by the drive means 20 oscillates through a predetermined angle $\alpha$ (FIG. 4), causing the beat-up reed 19 to oscillate with the reed carrier arm 18 through the same angle $\alpha$ to beat successive picks of the weft thread 29 one after another up to the fell of the fabric 12. Simultaneously with this, the oscillatory motion of the first rock shaft 13 is transmitted by the linkage 21 to the needle carrier arm 16 via the second rock shaft 14. The needle carrier arm 16 thus oscillates through a predetermined angle $\beta$ (FIG. 4) in timed relation to the oscillatory motion of the reed carrier arm 18. Consequently, the selvedge forming needle 17 moves to and fro through a distance d (FIG. 4) in timed relation to the angular movement of the beat-up reed 19, the distance d being variable with the angle $\beta$.

Figure 3:
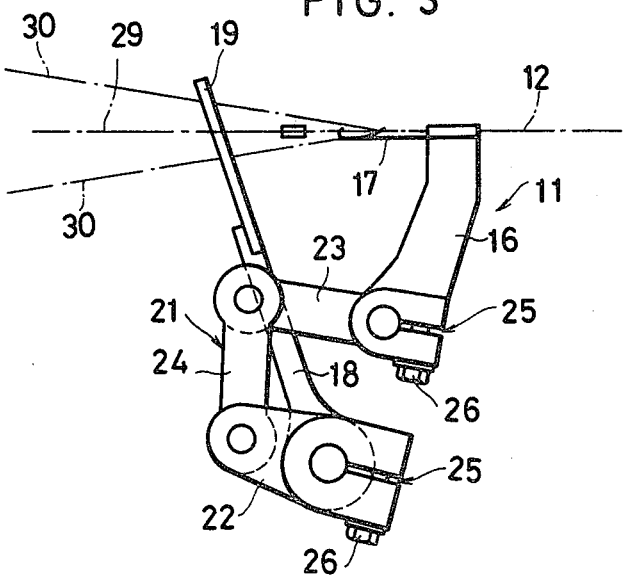
FIG. 3 is a diagrammatic front view of the mechanism showing the same in its starting disposition.

FIG. 3 illustrates the drive mechanism 11 in its starting disposition, in which the beat-up reed 19 has retracted and the selvedge forming needle 17 has moved forward beyond the fabric fell sufficiently to pick the weft thread 29 in the warp shed. FIG. 4 illustrates the mechanism 11 in its beat-up disposition, in which the reed 19 has now beaten the weft thread 29 up to the fabric fell and the selvedge forming needle 17 has retracted slightly beyond the fabric fell.

A single specific illustrative embodiment of the invention has been described. It will, of course, be appreciated however that the invention should not be limited to this specific embodiment since numerous changes and modifications may be made therein as appear obvious to those versed in the art without departing the scope of the appended claims.

What is claimed is:

1. A mechanism for driving a beat-up reed and a selvedge forming needle in timed relation in a needle loom, said mechanism comprising:

(a) a frame;

(b) a pair of parallel spaced first and second rock shafts rotatably supported on said frame;

(c) means for driving one of said first and second rock shafts to oscillate through a predetermined angle;

(d) a pair of first and second arms mounted on said first and second rock shafts, respectively, and adapted to support on their respective free ends the reed and the selvedge forming needle; and (e) a linkage connecting said first and second rock shafts with each other for transmitting such oscillatory motion of said one of said first and second rock shafts to the other rock shaft to reciprocate the selvedge forming needle in timed relation to an oscillatory motion of the beat-up reed, said linkage including a pair of first and second levers connected to said first and second rock shafts, respectively, and a link connected at opposite ends to respective free ends of said first and second levers, said free ends of said first and second levers pointing substantially the same direction so that said first lever and said link and said second lever are arranged in a pattern of generally C-shape, whereby said first and second rock shafts are oscillated in the synchronism with one another in the same direction.

2. A mechanism according to claim 1, including adjusting means on said first and second levers for allowing said first and second levers to move angularly with respect to said first and second arms about said first and second rock shafts, respectively, to selected angular position relative to said first and second arms, respectively, and for securing said first and second arms to said first and second rock shafts, respectively, in selected angular position.

3. A mechanism according to claim 2, in which said adjusting means on each of said first and second levers comprises a ring-shaped clamp extending around the respective one of said first and second rock shafts, and a fastening member for slackening and tightening said clamp.

* * * * *